United States Patent [19]

Shibano

[11] 4,114,161

[45] Sep. 12, 1978

[54] MAGNETIC CURRENT ANTENNA

[75] Inventor: Yoshizo Shibano, Kobe, Japan

[73] Assignee: Sumitomo Electric Industries, Ltd., Osaka, Japan

[21] Appl. No.: 573,885

[22] Filed: May 2, 1975

Related U.S. Application Data

[63] Continuation of Ser. No. 364,344, May 29, 1973, abandoned, which is a continuation of Ser. No. 863,035, Sep. 30, 1969, abandoned, which is a continuation of Ser. No. 605,656, Dec. 29, 1966, abandoned, which is a continuation-in-part of Ser. No. 376,142, Jun. 18, 1964, abandoned.

[30] Foreign Application Priority Data

| | | | |
|---|---|---|---|
| Jun. 21, 1963 | [JP] | Japan | 38-46468[U] |
| Jun. 21, 1963 | [JP] | Japan | 38-46469[U] |
| Jun. 21, 1963 | [JP] | Japan | 38-46470[U] |
| Jun. 21, 1963 | [JP] | Japan | 38-46471[U] |

[51] Int. Cl.[2] ..... H01Q 9/16; H01Q 9/30; H01Q 1/48; H01Q 1/36

[52] U.S. Cl. ..... 343/741; 343/806; 343/829; 343/846

[58] Field of Search ..... 343/895, 741, 742, 731, 343/732, 806, 829, 846

[56] References Cited

U.S. PATENT DOCUMENTS

| | | | |
|---|---|---|---|
| 2,636,986 | 4/1953 | Riderman | 343/895 |
| 2,985,878 | 5/1961 | Krause et al. | 343/85 |

*Primary Examiner*—Alfred E. Smith
*Assistant Examiner*—Marvin Nussbaum
*Attorney, Agent, or Firm*—Carothers and Carothers

[57] ABSTRACT

An antenna having a helically formed conductor positioned closely adjacent and in parallel relation with a conductor image means such as a conductive surface or the ground or another helix to provide an "image" of the helical conductor when the same is energized and thereby effectively cancel the vertically or axially polarized wave component and intensify the horizontally or transversely polarized wave component of the energized helical conductor.

9 Claims, 33 Drawing Figures

Fig. 2
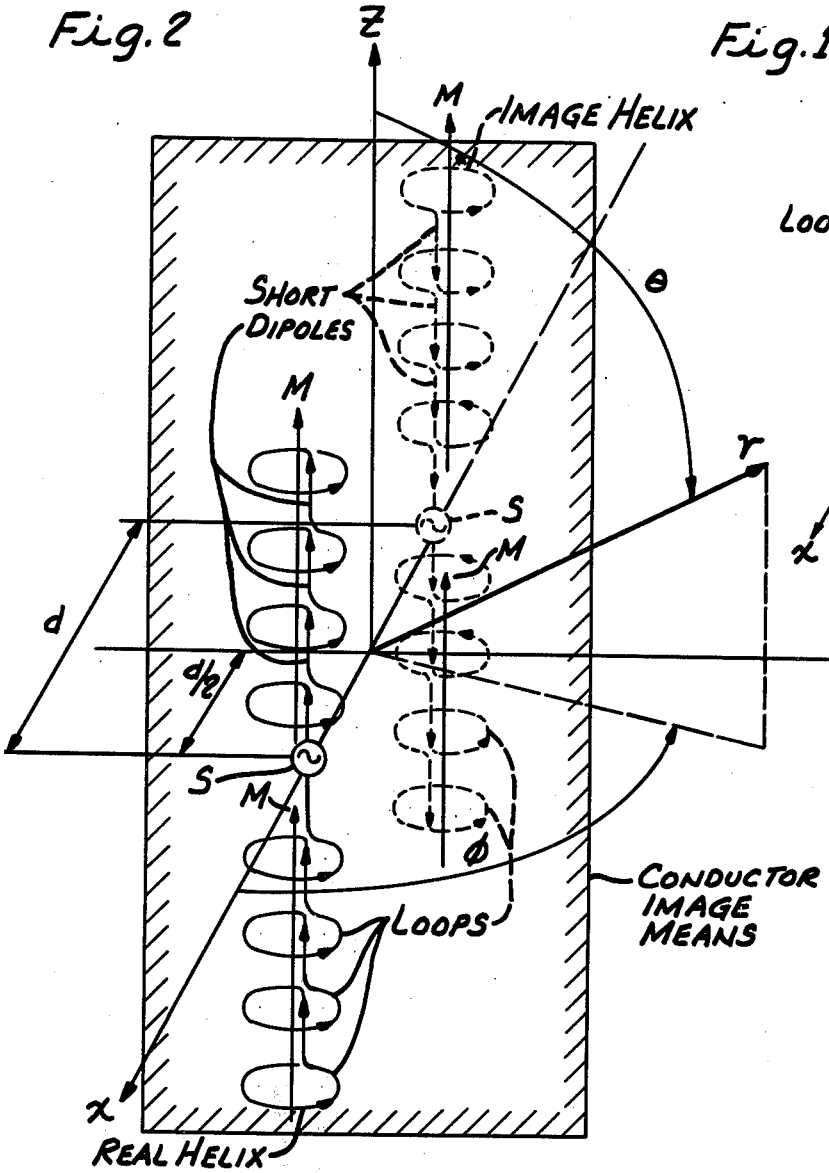
Fig. 1
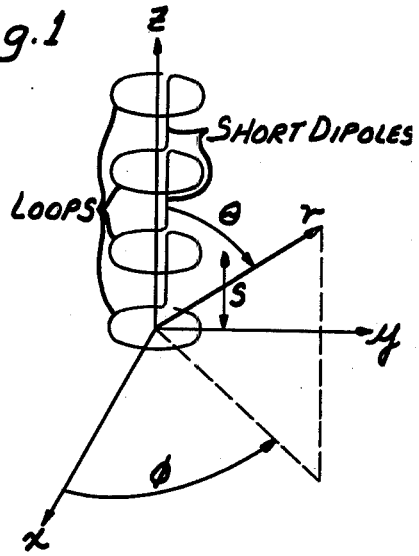
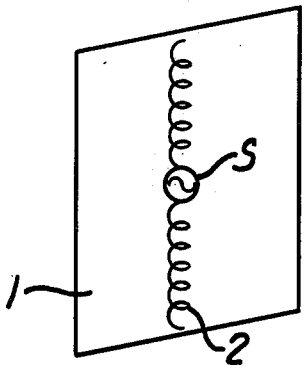
Fig. 3a
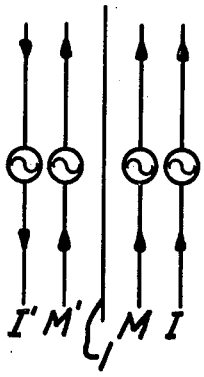
Fig. 3b
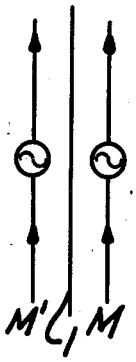
Fig. 3c
INVENTOR.
YOSHIZO SHIBANO
BY
CAROTHERS & CAROTHERS
HIS ATTORNEYS Fig. 4
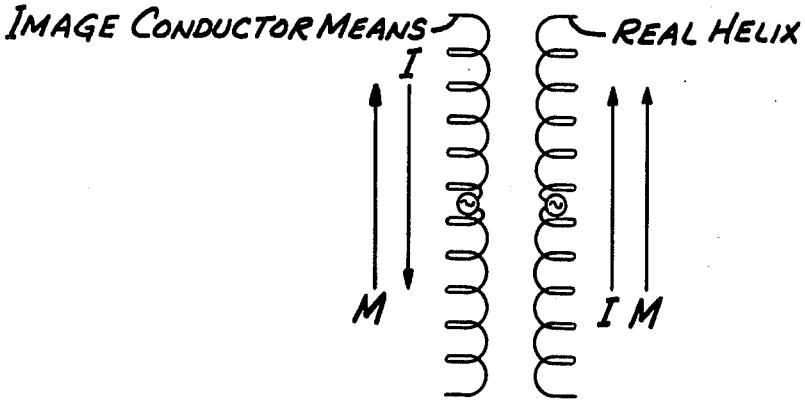
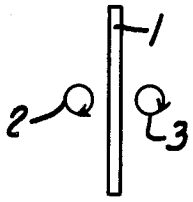
Fig. 5a
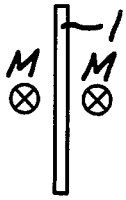
Fig. 5b
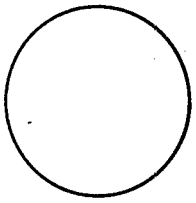
Fig. 5c
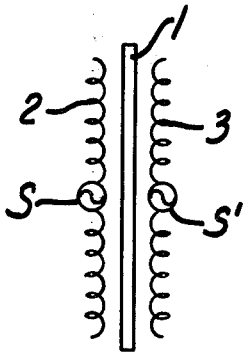
Fig. 5a'
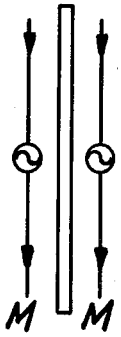
Fig. 5b'
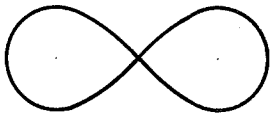
Fig. 5c'
INVENTOR.
YOSHIZO SHIBANO
BY
CAROTHERS & CAROTHERS
HIS ATTORNEYS

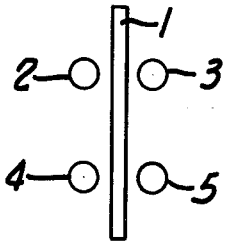
Fig.6a
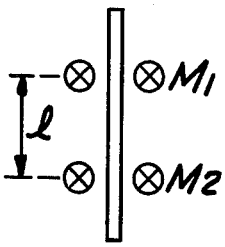
Fig.6b
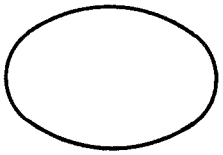
Fig.6c1
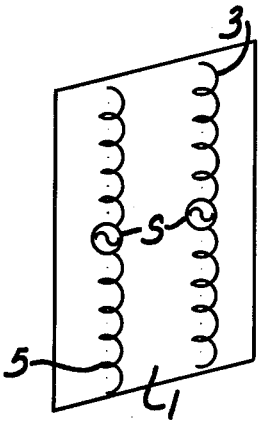
Fig.6a'
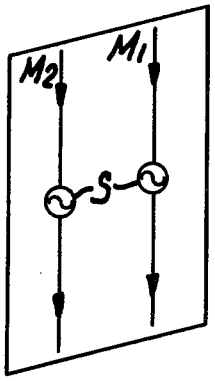
Fig.6b'
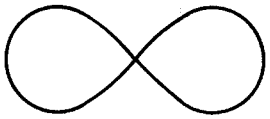
Fig.6c2
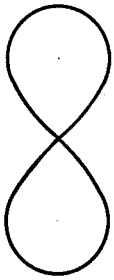
Fig.6c3
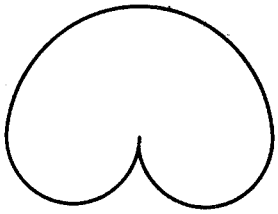
Fig.6c4
INVENTOR.
YOSHIZO SHIBANO
BY
CAROTHERS & CAROTHERS
HIS ATTORNEYS

INVENTOR.
YOSHIZO SHIBANO
BY
CAROTHERS & CAROTHERS
HIS ATTORNEYS

Fig. 10
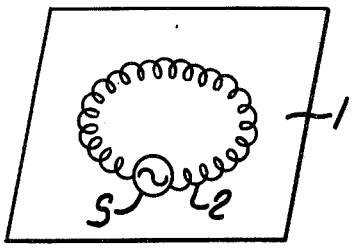
Fig. 11
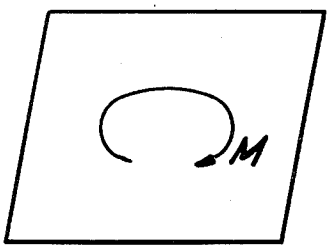
Fig. 12
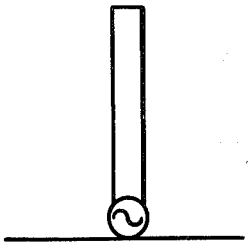
Fig. 13
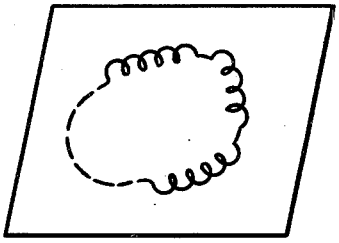
Fig. 14
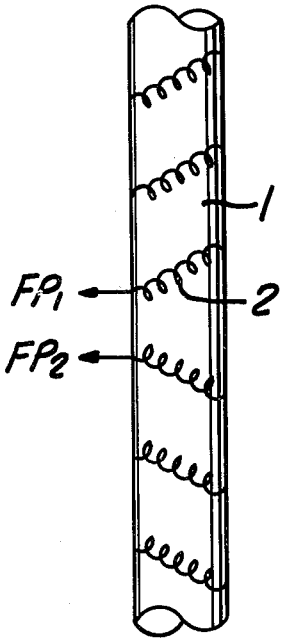
Fig. 15
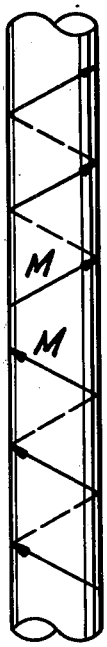
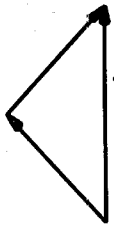
Fig. 16a
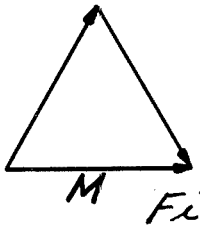
Fig. 16b
INVENTOR.
YOSHIZO SHIBANO
BY
CAROTHERS & CAROTHERS
HIS ATTORNEYS

MAGNETIC CURRENT ANTENNA

CROSS-REFERENCE TO RELATED APPLICATIONS

This is a continuation of application Ser. No. 364,344 filed May 29, 1973, now abandoned, which is a continuation of application Ser. No. 863,035 filed Sept. 30, 1969, now abandoned, which is a continuation of application Ser. No. 605,656 filed Dec. 29, 1966, now abandoned, which is a continuation-in-part of application Ser. No. 376,142 filed June 18, 1964, now abandoned.

BACKGROUND OF THE INVENTION

This invention relates generally to the field of reflector antennas and horizontally polarized wave antennas.

As is widely known, in the art of antennas which have hitherto been in use, there have been difficult problems concerning the special arrangement of antenna elements and the phase for excitation to obtain a specific, desired radiation pattern. Furthermore, they have a shortcoming in that their dimensions have to be large because of the necessity to increase the generated voltage.

It is useful for the purposes of mathematical analysis of antennas to describe the radiation from a small loop of current by replacing it with an equivalent magnetic dipole which carries a fictitious magnetic current. This so called magnetic current is a fictitious quantity represented by a vector whose magnitude M is proportional to the current I flowing in a small conductive loop and whose direction is perpendicular to the plane of said loop. With this in mind, the antenna of the present invention will be described in terms of such a magnetic current for the sake of convenience and clarity.

Hitherto, it has also been considered impractical to obtain pure magnetic current radiation (radiation from a small loop current) in appreciable quantities to provide a practical antenna which has a pure magnetic current distribution. The single minor electric loop of current previously described is so small and insignificant that it alone does not provide a practical or realizable magnetic current antenna for any known present day application. Also the single larger loop antenna of today does not solve this problem as it loses the characteristics of the minor electric loop and can no longer be equated to a pure magnetic current distribution having horizontally polarized waves alone. So also a helical coil of small diameter alone does not overcome this problem as such helical antennas are either elliptically or circularly polarized. Until the present invention, no one has effectively eliminated the vertical polarized wave component from a helix radiating an elliptical polarized wave to produce horizontal polarized wave radiation alone thereby providing an antenna with an effectively pure magnetic current radiation. Thus the prior art has been unable to supply an antenna which comprises many small or minor electric loop currents to provide an effective and practical magnetic current antenna. It is only the minor electric loop which provides pure so-called magnetic current but hitherto no one has conceived a practical means of employing it to provide a magnetic current antenna.

SUMMARY

The object of this invention, is the provision of a pure magnetic current antenna, as thought of in terms of the previously described concepts, based on the principle of electromagnetic image which has an energized coil and a conductor plate or other image or reflector means which is closely adjacent to the coil. It thus becomes possible to obtain the wanted radiation pattern by a comparatively simple arrangement of coils and their excitation. In addition, the antenna thus provided is of a very small size because it is a magnetic current antenna requiring small loops of current.

In antennas in general, horizontally polarized waves are radiated from the horizontal component of electric current and vertically polarized waves from the vertical electric component, while horizontally polarized waves are radiated from the vertical component of magnetic current and vertically polarized waves from the horizontal component.

This invention aims at supplying the energy to a magnetic current component by eliminating the vertical electric current component of a helix using the "image" of a conductor image means or reflector. For the purpose of analysis the small helix can be considered to be made up of a series or stack of loops, each in a plane parallel to the next, connected by short dipoles oriented perpendicular to the planes of the loops. Such analysis is described in "Antenna Analysis by Edward A. Wolff, copyright 1966 by Join Wiley and Sons, Inc., page 438. The helix is energized and placed adjacent and in parallel relation with a conductor surface. This produces an "image" helix. In other words a reflected wave is produced which can be considered to be radiating from an "image" of the helix antenna located on the opposite side of the conductor surface from which the actual helix is located and spaced an equal distance therefrom. The polarities of corresponding points on the real and image antennas will be reversed. Thus the image helix will appear to be wound in the opposite direction of the real helix and to have a current flowing therein in the opposite direction. This is necessarily so since the reflector surface or conductor image means remains at zero potential at all times. In other words, the image helix is used to replace the reflector and achieve a zero potential surface in a plane equidistant between and parallel to the image and real helix. Such principles are well established and reference thereto may be made in any number of publications such as chapter 7 of *Antenna Analysis*, or section 21-7 of *Electronic Designers' Handbook* by Landee, Davis and Albrecht, copyright 1957 by McGraw-Hill Book Company, for example. When the real helix is placed closely adjacent and in parallel relation with the conductor surface, the image effect causes the vertical electric components in the short dipoles connecting the series of small loops of the image and real helixes to effectually cancel each other and the small electric loops of the image and real helixes become additive thereby providing an effectively pure and practical magnetic current antenna which radiates horizontally polarized waves alone and can thereby be easily utilized to obtain the desired radiation pattern by a comparatively simple arrangement of coils and their excitation or phasing with the added advantage of being very small in size.

The reflector or conductive surface may also be replaced by an actual helical conductor which has all the characteristics of the image coil which is produced by the conductive surface.

These and other objects and advantages are further explained and appear in the following description and claims.

The accompanying drawings show, for the purpose of exemplification without limiting the invention or claims thereto, certain practical embodiments illustrating the principles of this invention wherein:

FIG. 1 is a diagrammatic view illustrating the properties of a helical conductor wherein the helix is analyzed as a series of short dipoles and loops.

FIG. 2 is a diagrammatic view of an embodiment of the antenna of the present invention wherein the analysis of the helix shown in FIG. 1 is utilized.

FIG. 3 (a) is a diagrammatic view illustrating the embodiment of FIG. 2 in a different manner.

FIGS. 3 (b) and (c) are diagrammatic views illustrating the radiating components of FIG. 3 (a).

FIG. 4 is a diagrammatic view showing another embodiment of the magnetic current antenna of the present invention and its radiation components wherein the structure of the image means has been changed.

FIGS. 5 (a), (b) and (c) are diagrammatic plan views showing an embodiment of the present invention and its radiation patterns illustrating the use of more than one helical conductor.

FIGS. 5 (a'), (b') and (c') are diagrammatic views in side elevation which correspond respectively to FIGS. 5 (a), (b) and (c).

FIGS. 6 (a) and (b) are diagrammatic plan views illustrating an embodiment of the present invention wherein the radiation pattern may be varied as desired.

FIGS. 6 (a') and (b') are diagrammatic perspective views of the antenna shown in FIGS. 6 (a) and (b) respectively.

FIGS. 6 (c1), (c2) and (c3) and (c4) are diagrammatic views illustrating variations which may be obtained in the horizontal radiation pattern of the antenna shown in FIGS. 6 (a) and (a').

Figure 7A:
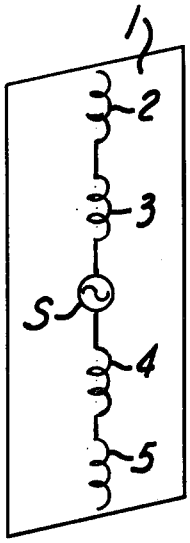
Figure 7B:
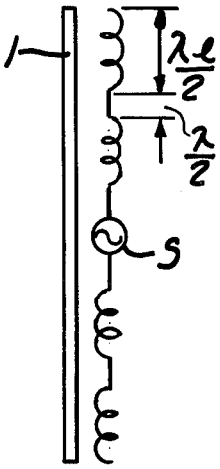
Figure 7C:
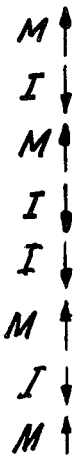

FIGS. 7 (a), (b) and (c) are diagrammatic perspective, end and radiation component views respectively of an embodiment of the present invention.

Figure 8:
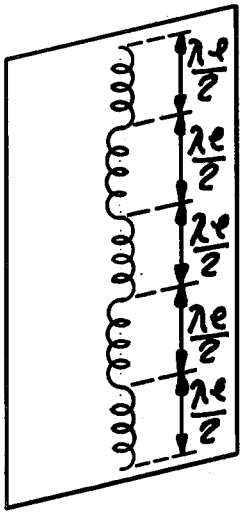

FIG. 8 is a diagrmmatic perspective view illustrating a variation of the antenna shown in FIG. 7 (a).

Figure 9:
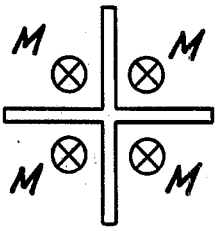

FIG. 9 is a diagrammatic view illustrating a variation of the antenna of the preset invention wherein four helix and two reflector plates are employed.

FIG. 10 is a diagrammatic plan view illustrating an embodiment of the present invention which is equivalent to a unipole antenna.

FIG. 11 is a diagrammatic plan view illustrating the magnetic current induced by the energized helical coil in the antenna shown in FIG. 10.

FIG. 12 is a diagrammatic view in side elevation showing a unipole antenna which is equivalent to that shown in FIG. 10.

FIG. 13 is a diagrammatic plan view illustrating a variation of the embodiment of FIG. 10.

FIG. 14 is a diagrammatic view in side elevation illustrating a variation of the present invention wherein the image means is a conductive cylinder.

FIG. 15 is a diagrammatic view in side elevation of the antenna shown in FIG. 14 illustrating the magnetic current radiation component distribution.

FIGS. 16 (a) and (b) are vector diagrams illustrating two differet types of radiating magnetic components which may be obtained in the antenna shown in FIG. 14.

A small helix can be considered to be made up of loops in planes parallel to the Z = O plane connected by short dipoles oriented parallel to the Z axis as shown in FIG. 1. The far field of the small loop is $$E_\phi = \frac{Z_o \pi I \sin\theta A_g e^{-jkr}}{\lambda 2_r}$$

where $Z_o$ is the impedance of the medium, $I$ is the current in the loop, $A_g$ is the geometrical area of the loop, $\lambda$ is the operating wavelength, $\theta$ is the angle between the Z axis and the radial line to the far field, and $r$ is the radial distance to the far field. The far field of the short dipole is $$E_\theta = \frac{j Z_o I_s \sin\theta e^{-jkr}}{2\lambda_r}$$

where $s$ is the dipole length. Reference may be made to pages 438 and 439 of *Antenna Analysis Id,* to substantiate these equations. These equations show that the two components of the far field are 90° out of phase and the sum of these fields illustrate that the helix is elliptically polarized. The antenna of the present invention effectively eliminates the vertically polarized wave component $E\theta$ from the short dipoles.

FIG. 2 illustrates an embodiment of the antenna of the present invention utilizing the helix of FIG. 1 wherein the real helix energized by source s with current flow indicated by the arrows on the helix and is mounted closely adjacent and in parallel relation with the conducting screen or conductor image means. This produces the image helix as previously explained in the summary which is wound in the opposite direction of the real helix and has a current which is in the opposite direction as indicated by the arrows on the image helix. The real helix is spaced from the reflector at a distance of $d/2$ which is small compared to the operating wavelength and generally about one-tenth of the wavelength ($\lambda/10$).

This antenna can be analyzed as a two-element helix array. By using the far field equation $E_\theta$ of the dipoles as previously given and the principles of antenna array, $E_\theta$ for the array will easily be found to be as follows:

$$E_\theta = \frac{E_o I_s \sin\theta e^{-jkr}}{2\lambda_r} \times 2 \sin(Kd \sin\theta)$$

For the evolution of this equation reference may be made to chapter 6 of *Antenna Analysis* Id. If the distance $d$ is much smaller than the operating wavelength ($d << \lambda$) then $Kd = (2\pi/\lambda)\, d << 1$. As the distance $d$ therefore approaches 0 ($d \rightarrow 0$), $Kd$ also approaches 0 ($Kd \rightarrow 0$) and namely $\sin(Kd - \sin\theta) \rightarrow 0$ with the result that $E_\theta$ approaches zero ($E_\theta \rightarrow 0$). From this analysis it may be seen that $E_\theta$, the vertically polarized wave component is effectively cancelled by the action of the image plate.

With respect to the loops, the far field $E_\phi$ for the array is found to be as follows:

$$E_\phi = \frac{Z_o \pi I \sin\theta A_g e^{-jkr}}{\lambda 2_r} \times 2 \cos(Kd \sin\theta)$$

If $d$ is nearly equal 0, then $\cos(Kd \sin\theta) \rightarrow 1$. Therefore $$E_\phi \longrightarrow \frac{2\,Z_o\,\pi I \sin\theta A_g\,e^{-jkr}}{\lambda 2_r}$$

Thus with respect to the loop current component, it is doubly intensified by the action of the image plate. Thus a single polarized wave antenna which effectively cancels the vertically polarized wave component and intensifies he horizontally polarized wave component is obtained. As the antenna radiates from the small loops alone, these current loops may be represented by the magnetic current components M. Thus the antenna of the present invention obtains substantially pure magnetic current radiation. By the teachings of the present invention pure magnetic current distribution is obtained which was not otherwise possible to obtain from a coil or helix.

In FIGS. 3 (a), (b) and (c) and (1) in (a) denotes a conductor image means in the form of a conductor plate and (2) a helical formed antenna element placed tangentially adjacent it and (5) an electric energy source or signal generator. FIGS. 3 (a), (b) and (c) are merely other means of illustrating the principles of FIG. 2. As shown in FIG. 3 (b), its equivalent circuits produced are electric current element (I) and magnetic current element (M) and, in addition to these, electric current element (I') and magnetic current element (M') due to the image. Of these elements, the electric current elements (I') and (I) are in directions opposite to each other, so that the radiation effects of these elements are eliminated by each other, while the magnetic current elements (M') and (M) are in one and the same direction as shown in FIG. 3 (c), so that they are added together and effect radiation of a high efficiency.

The above explanation refers to a combination of a linear helically formed conductor and a plane conductor plate. However, the helical conductor need not necessarily be linear, but may be given any desired shape, while the conductor plate need not necessarily be a plane but may be given any desired shape such as a cylindrical surface, spherical surface, etc.

It is further possible to make another structural variation of the magnetic current antenna of the present invention. As shown in FIG. 4, a second real helically formed conductor is employed as the conductor image means corresponding to the image which is yielded by the reflector is installed and the reflecting plate is eliminated. That is to say, coil or helical conductors which are wound in opposite directions to each other are placed closely side by side and an equal current are permitted to flow in them in opposite directions to each other. It is also possible to attain the objective by coaxially positioning the helical conductors wound in directions opposite to each other.

The present invention is based on the above mentioned principle of a magnetic current antenna and also includes the under mentioned applications of a magnetic current antenna.

The first of the applications relates to a magnetic current antenna radiating horizontally polarized waves. FIG. 5 shows a basic example of a magnetic current antenna which has two coils and one conducting plate. FIGS. 5 (a) and (a') are a top view and a side view, respectively, of an antenna in which coils 2 and 3 are placed on both sides of and in close proximity to a vertical conducting plate (1) and are excited by electric supply sources (S) and (S') placed in the middle of each of the coils. In the top view (a), the arrow by each coil shows the direction of the excitation current. As is known from the principle of a magnetic current radiation, the radiation from the above mentioned antenna is equivalent to the radiation from the magnetic currents (M) as shown in FIGS. 5 (b) and (b'). If the distance between the two magnetic currents (M) is made small enough as compared with the wave length, the horizontal radiation pattern of the antenna is such that, as shown in FIG. 5 (c), there is omni-directivity in the horizontal plane, which in the vertical plane the pattern resembles the mathematical symbol of infinity ($\infty$). A doughnut shaped directivity as shown in FIG. 5 (c') is obtained. In this case, the polarization of the radiated wave is of course horizontal. FIG. 6 shows the combination of a plurality of the elements shown in FIG. 5 for producing an appropriate directivity in the horizontal plane. In FIG. 6 (a) which is a top view, 1 denotes a vertical conducting plate.

Groups of helical coils 2 and 4, and 3 and 5 are provided on either side of said conducting plate parallel and in proximity thereto. The helical coils 2 and 4, and 3 and 5 are also parallel to each other. The distance between the coils 2 and 4, and 3 and 5, is *l*. Electrical energy sources $S_2$, $S_3$, $S_4$ and $S_5$ are provided at the middle of the helical coils 2, 3, 4, and 5 respectively. Helical coils 2 and 3 and helical coils 4 and 5 are excited in the same phase at all times respectively.

By exciting the coils 2 and 4, and 3 and 5 in various different phases, various horizontal patterns may be obtained.

The antenna shown in FIG. 6 (a) has the radiating magnetic current components $M_2$, $M_3$, $M_4$ and $M_5$ shown in FIG. 6 (b).

FIG. 6 (a') and FIG. 6 (b') are slant views corresponding to FIG. 6 (a) and FIG. 6 (b) respectively.

In FIG. 6 (a'), 1 denotes the conductor plate, 3 and 5 the coils, and S the electric supply sources for the excitation of the coils 3 and 5.

With the arrangement shown in FIG. 6, it is possible to choose any of a wide variety of horizontal patterns, as required, by suitably selecting the excitation phase of the four helical coils and the distanct (*l*) between the helical coils. Examples which are practicable are explained. In all of these examples, the vertical pattern is the same as that shown in FIG. 5 ($C_1$).

In the first example, the coil distance selected is $\lambda/4$ ($\lambda$ = wave length in free space), and all the four coils are fed in one and the same phase. In this case, we get a horizontal pattern of an elliptical shape as shown in FIG. 6 ($C_1$).

In the second example, the four helical coils are fed in one and the same phase and the distance *l* is $\lambda/2$.

In this case, we get a horizontal pattern as shown in FIG. 6 ($C_2$).

In the third example, *l* is $\lambda/2$ and the feeding phases for the group of helical coils 2 and 3 and for the group of helical coils 4 and 5 are differentiated 180°. (The same phase within one group.)

In this case, we get a figure eight-shaped horizontal pattern as shown in FIG. 6 ($C_3$).

In the fourth example *l* is $\lambda/4$ and the feeding phase for the group of helical coils 4 and 5 is advanced 90° ahead of the feeding phase for the group of helical coils 2 and 3. In this case, we get a cardioil-shaped pattern as shown in FIG. 6 ($C_4$).

As shown above, we can get a variety of patterns by suitably selecting the feeding phase for each helical coil and the coil distance.

FIG. 7 shows an embodiment of the present invention which comprises one conducting plate and two groups of the same number of helical coils which are arranged and connected in series on one line and extended in opposite directions from the electric energy source point, and a diagram of the radiating magnetic components, FIG. 7 (a) is a perspective view of this antenna and FIG. 7 (b) is a side view. In FIG. 7 (a) and (b), 1 denotes a conducting plate and 2, 3, 4 and 5 are helical coils and S is the electric energy source.

In FIG. 7 (a) and (b), the length of each coil 2, 3, 4 and 5 is made in effect $\lambda e/2$ (here $\lambda e$ is the wave length in the coil) and these helical coils 2 3 4 and 5 are arranged in one line, spaced by a distance $\lambda/2$ (here $\lambda$ is the wave length in free space), connected in series by a linear conductor and placed parallel to the vertical conducting plate and in proximity thereto. Energy source S is connected in series with the linear conductor of a $\lambda/2$ length between the coil 3 and 4. if this assembly is excited from the electric energy source (S), the distribution of electric currents (I) and magnetic currents (M) on the antenna will be as shown in FIG. 7 (c). The radiation by electric currents (I) being eliminated by their images, there will be an antenna of magnetic currents (M) only.

FIG. 8 shows a variation of the embodiment of the present invention shown in FIG. 7. In the embodiment shown in FIG. 8, helical coils wound in the opposite direction, each having a length of $\lambda e/2$, take the place of the linear conductors used in the embodiment shown in FIG. 7. For excitation, the electric energy source may be connected in series at the end of this group of coils or at the middle point of the unit coil of $\lambda e/2$ length of the middle of the group.

FIG. 9 shows an example of magnetic current antenna where conducting plates are combined together in a cross and four coil conductors are placed, one in each corner. If these antenna coil elements are excited in the same phase, a horizontal omni-directional pattern is obtained, and if they are excited in suitable phases, a suitable pattern can be obtained, as can easily be understood from the foregoing explanation.

These examples are those in which a conducting plate is employed. It is, however, obvious that the objective may be attained by using elements corresponding to the image without a conducting plate as shown by the conductor image means in FIG. 4.

The second of the applications provides a magnetic current antenna radiating vertically polarized waves which takes the place of a unipole antenna. FIG. 10 shows a unipole antenna embodying the present invention.

In FIG. 10, 1 denotes a conducting plate and 2 a ring-shaped coil conductor placed closely on the conducting plate. Through the combination of these two, an antenna equivalent to a magnetic current loop antenna having a magnetic current (M) as shown in FIG. 11 will be produced, and it is evident that it is equivalent to a unipole antenna which stands upright as shown in FIG. 12. Its pattern is therefore a semi-doughnut shaped one. Naturally, in consequence, the polarization of the wave is vertical. The same effect will be obtained also by making use of the ground surface in place of the conducting plate.

This example is an instance where a helical coil is formed into a loop in proximity of a conducting plate, so that the antenna is of a very small size. It is highly effective in reducing the height of the antenna, when used in place of a unipole antenna.

The third of the applications relates to a magnetic current antenna in which the foregoing two examples are combined together in order to make it possible to synthesize a suitable directivity. As shown in FIG. 13, several coil conductors are suitably laid upon a conducting plate. The length and magnitude of the radiating magnetic current component in this assembly can be controlled suitably by selecting the length of coil conductor and the diameter of the coil. It may synthesize the directivity of a magnetic current antenna by making this magnetic current distribution suitable. In the present example, a magnetic current antenna employing a conducting plate has been explained. But it is possible to eliminate the conducting plate through the use of such coil elements as shown in FIG. 4.

The fourth of the application relates to a helical magnetic antenna.

In this example, a helically formed conductor 2 is helically wound around in the proximity of the circumference or tangentially adjacent of the conductor image means in the form of the metal cylinder 1 as shown in FIG. 14. Here, the length of each turn along the helix around a metal cylinder 1 is made an integral multiple of the propagation wave length in the helix. Equivalently, this antenna may be represented by a helical distribution of magnetic current M as shown in FIG. 15. As the length of each turn along the helix around a metal cylinder is made an integral multiple of the propagation wave length in the helix, an array in the same phase of magnetic current is formed in one projected plane which is parallel to this axis of cylinder 1. Therefore a side-fire antenna can be obtained. If the feeding terminals $FP_1$ and $FP_2$ in FIG. 14 are excited in opposite phases, the radiation by magnetic current viewed with respect to the lateral direction will be shown by the vector in FIG. 16 (a), the resultant vector of the magnetic current has only a vertical component and the radiated electromagnetic field is of a horizontally polarized wave. If $FP_1$ and $FP_2$ are excited in the same phase, only the horizontal component of the magnetic current will remain as shown by the vector in FIG. 16 (b) and so a vertically polarized wave is radiated. Horizontally and vertically polarized waves may be obtained like this by changing the way of excitation. If the inclination of the magnetic current is made $\pm$ 45° and excitation is made with a phase difference of 90° at $FP_1$ and $FP_2$, a circularly polarized wave can be obtained. As magnetic current helical antenna in accordance with the invention is constructed by helically winding a helically formed conductor in the proximity of a metal cylinder, it has very small wind resistance and is therefore a very strong mechanical structure. In addition, as the propagation speed of the wave in the helix is slower than that in free space, the wave length becomes shorter and the diameter of the antenna (metal pole) smaller, resulting in a smaller size of the antenna. This fact is found exceedingly advantageous for an antenna for VHF band, particularly for antennas for channel TV and vehicle communication, etc.

The different embodiments shown in FIGS. 2 through 16 and described in the specification are but a few applications of the basic magnetic current antenna as taught by the present invention. It should be noted that in all of these embodiments the image coil or helix, whether it be a real or actual helix or an imaginary substitution for the reflector, is always in parallel relation with the real helix or coil. This is necessarily so in order to obtain the given objects of the present invention. Thus in the embodiment of FIG. 4, the conductor image means is a real or actual helix which is utilized as the image of the real helix and is in parallel relation with the real helix. So also, when this particular image helix is placed coaxially with respect to the real helix, both helixes still remain in a parallel relationship.

Likewise in all the remaining embodiments the image helix follows the real helix in parallel relation. This is so because the conductive surface of the reflector type conductor image means must follow the path of the real helix. Thus it may be said that the reflector surface also follows the real helix in a parallel relation. This is true even for the embodiment of FIG. 14 wherein the real helix is always tangentially adjacent the conductive surface and thus in parallel relation therewith or in parallel relation to this conductive image means. The term parallel relation as used in the claims therefore describes the embodiment of FIG. 14 as well as the remaining embodiments.

However, the conductive image means must always be either or produce by the image principle, a helix of substantially the same length and number of turns as the real helix but wound in the opposite direction and having current flowing therethrough in the opposite direction. It can be readily seen that if a conductor is helically wound around a cylindrical conductor, instead of winding a helix in a helical manner around the cylindrical conductor as shown in FIG. 14, that an image of the helix will not be produced as required by the present invention, but rather, the image would be that of a helix wound in the same direction as the real helix. Therefore, for the purpose of definition in the following claims, the term conductor image means is limited to an actual helix, or reflector or ground surface which is or produces a correct mirror image of the real helix as an entirety as previously described.

I claim:

1. A magnetic current antenna comprising a plurality of helical conductors each forming a coil having its interior unobstructed with any conductive material and having one end electrically connected to a transmission signal from a signal generator, and a conductive surface adjacent to and uniformly spaced from said helical conductors and coextending in parallel with the longitudinal helical axis of each of said helical coils and extending away from each of said helical conductors in both directions transverse to each of said longitudinal helical axes at any given point therealong in a common straight line, for at least as long as the full underlying diameter span of said helical conductors, said conductive surface being spaced from said longitudinal axis of each of said helical coils a distance which is small compared to the antenna operating wave length, said helical conductors positioned adjacent and uniformly spaced from said conductive surface and symmetrically positioned with respect to a plane perpendicular to said conductive surface, said helical conductors being energized by said transmission signal to provide a radiation pattern variable by changing the phase relationship of and distance between said helical conductors.

2. A magnetic current antenna comprising a first helical conductor electrically connected at one end to a transmission signal from a signal generator, and a second helical conductor wound in the opposite direction of said first helical conductor with substantially the same pitch and diameter and electrically connected at one end to said transmission signal 180° out of phase, said helical conductors axially coextending with each other in the same direction with said electrical connections positioned adjacent each other and having their helical axes spaced apart at the most a distance which is small compared to the antenna operating wave length.

3. A magnetic current antenna comprising a plurality of first helical conductors electrically connected at one end to a transmission signal from a signal generator to provide a radiation pattern variable by changing the phase relationship of and distance between said first helical conductors, and a conductive planar surface positioned adjacently parallel to said first helical conductors to provide coextending image helical conductors wound in the opposite direction of said first helical conductors with substantially the same pitch and diameter and energized with said transmission signal 180° out of phase with their helical axes spaced apart at the most a distance which is small compared to the antenna operating wave length, said plurality of helical conductors consisting of a pair of said first helical conductors positioned coextensively in parallel with each other on opposite sides of said planar conductive surface.

4. The magnetic current antenna of claim 3 characterized by an additional pair of said first helical conductors positioned coextensively in parallel with each other on opposite sides of said planar conductive surface and with said first pair of helical conductors.

5. The magnetic current antenna of claim 4 characterized by a second planar conductive surface intersecting said first conductive surface at right angles to form a plus-shaped cross-section configuration which separates said four first helical conductors each into a different quadrant, each of said first helical conductors being spaced from both of said planar conductive surfaces a distance which is small compared to the antenna operating wave length.

6. A magnetic current antenna comprising a plurality of first helical conductors axially aligned with each other and each having an axial length equal to one-half of the operating wave length with linear conductors joining said helical conductors in series and having a length equal to one-half of the wave length in free space and with one end of said series of first helical conductors electrically connected to a transmission signal from a signal generator, and a conductive surface coextending adjacent to and uniformly spaced from said joined first helical conductors in their axial direction and extending away from said first helical conductors in the direction transverse to their helical axes at any given point therealong in a substantially straight line, said conductive surface being spaced from said first helical conductors a distance which is small compared to the antenna operating wave length.

7. A magnetic current antenna comprising a first helical conductor formed in the shape of a ring and electrically connected at one end to a transmission signal from a signal generator, and a conductive surface coextending adjacent to and uniformly spaced from said first helical conductor in its axial direction and extending away from said first helical conductor in the direction transverse to its helical axes at any given point therealong in a substantially straight line, said conductive surface being spaced from said first helical conductor a distance which is small compared to the antenna operating wave length.

8. A magnetic current antenna comprising a first helical conductor electrically connected at one end to a transmission signal from a signal generator, and a conductive cylindrical surface having a diameter greater than the helical diameter of said first helical conductor with said first helical conductor and the helical axis thereof being helically wrapped around said cylindrical surface in uniformly spaced adjacent proximity to said surface, a second helical conductor identical to the first and helically wrapped around said cylindrical conductor adjacent to and in the opposite direction of said first helical conductor, and signal generator means electrically connected to said first and second helical conductors at one end to energize the same.

9. The magnetic current antenna of claim 8 wherein each helical wrap of said helical conductors around said cylindrical conductive surface is equal to an integer multiple of the antenna operating wave length.

* * * * *